US005735754A

United States Patent [19]

Antonious

[11] Patent Number: 5,735,754

[45] Date of Patent: Apr. 7, 1998

[54] AERODYNAMIC METAL WOOD GOLF CLUB HEAD

[76] Inventor: Anthony J. Antonious, 7738 Calle Facil, Sarasota, Fla. 34238

[21] Appl. No.: 759,924

[22] Filed: Dec. 4, 1996

[51] Int. Cl.[6] ..... A63B 53/04

[52] U.S. Cl. ..... 473/328; 473/345

[58] Field of Search ..... D21/214, 215, D21/216, 217, 218, 219, 220; 473/327, 328, 324, 228, 286, 345, 346

[56] References Cited

U.S. PATENT DOCUMENTS

| | | | |
|---|---|---|---|
| D. 350,176 | 8/1994 | Antonious | D21/214 |
| D. 363,749 | 10/1995 | Kenmi | D21/214 |
| D. 364,204 | 11/1995 | Lin | D21/214 |
| 2,041,676 | 5/1936 | Gallagher | 473/328 |
| 2,550,846 | 5/1951 | Milligan | 473/327 |
| 3,841,639 | 10/1974 | Werner | 473/286 |
| 5,271,622 | 12/1993 | Rogerson | 473/327 |
| 5,314,185 | 5/1994 | Gorman | 473/327 |
| 5,456,469 | 10/1995 | MacDougall | 473/328 |
| 5,467,988 | 11/1995 | Henwood | 473/328 |
| 5,524,890 | 6/1996 | Kim | 473/327 |

*Primary Examiner*—Sebastiano Passaniti
*Attorney, Agent, or Firm*—Aquilino & Welsh

[57] ABSTRACT

A metal wood type golf club head having a c-shaped aerodynamic configuration formed in the bottom surface adjacent a rear surface and having an open end extending forwardly toward the ball striking face in combination with a skid surface.

8 Claims, 3 Drawing Sheets

FIG. 4
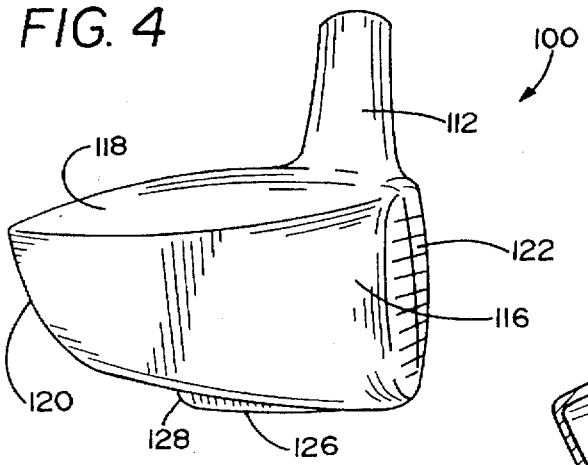
FIG. 5
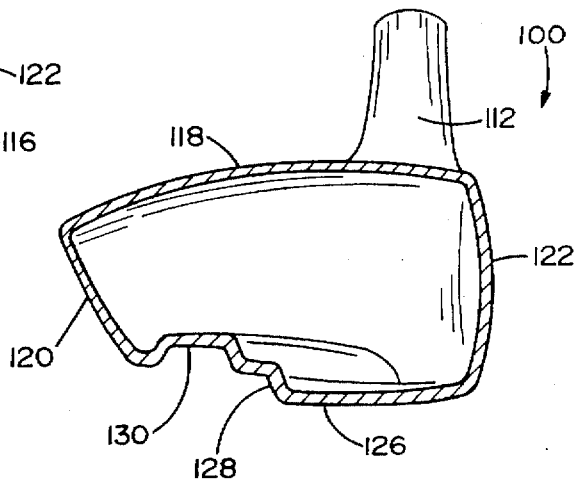
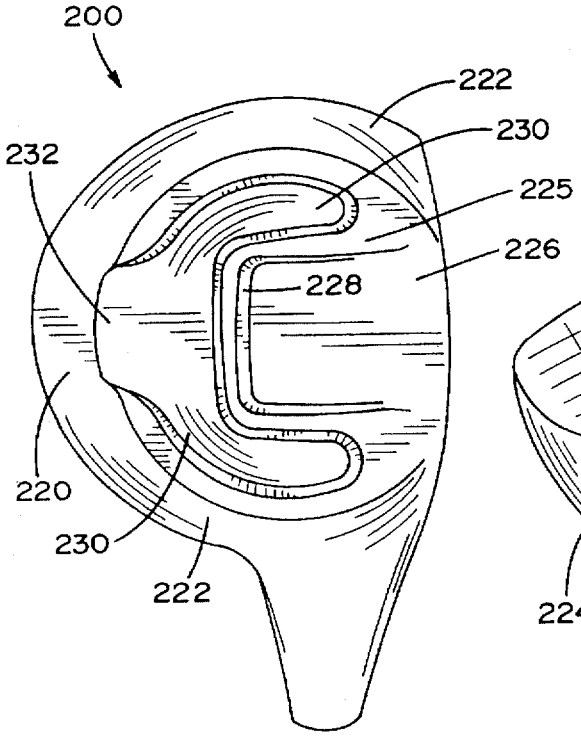
FIG. 6
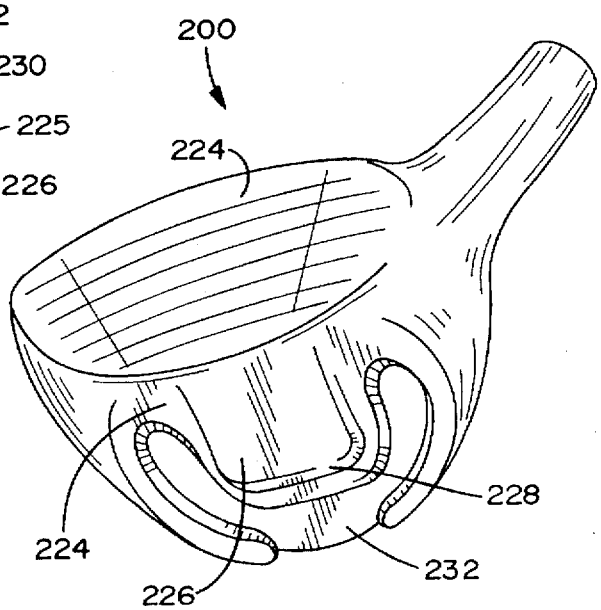
FIG. 7

FIG. 8
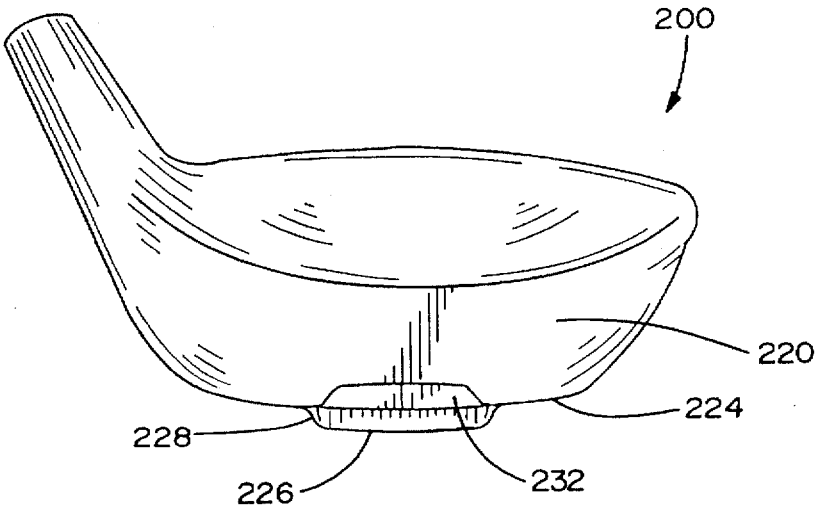
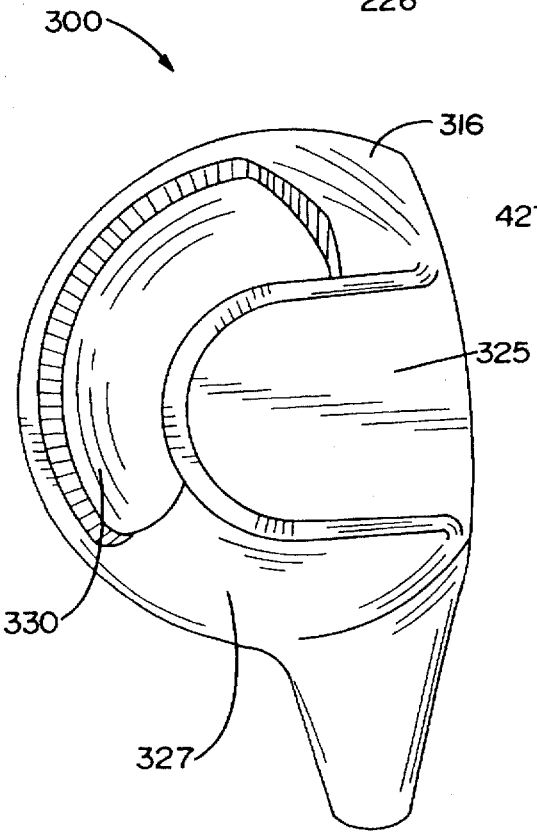
FIG. 9
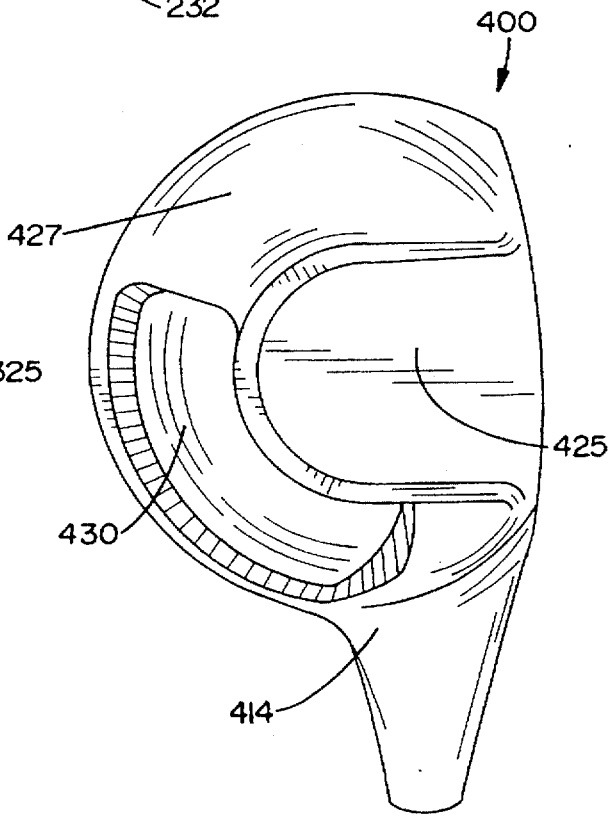
FIG. 10

AERODYNAMIC METAL WOOD GOLF CLUB HEAD

BACKGROUND OF THE INVENTION

The present invention relates to golf club heads and in particular to a metal wood type golf club head having an improved aerodynamic surface on the bottom rear of the sole.

Wood and metal wood type golf club heads are used for hitting a golf ball a longer distance and are usually used for the first shot of a given golf hole from a tee position. Fairway clubs of the same type are also used "through the green" on a golf hole to obtain maximum distance in the direction of or onto a putting surface. The distance the ball travels is determined by the club head speed at the moment of impact and the weight of the club head in accordance with well known laws of physics. Typical wood and metalwood golf club of this type have aerodynamic surfaces, but conventional shapes create substantial air turbulence, which, in turn, causes adverse erratic movement and aerodynamic drag that reduces the club head speed generated for a given force developed by a golfer for a particular golf swing.

Over the years, club heads have been developed with aerodynamic shapes to increase club head speed by reducing the aerodynamic drag of the club head as it is swung. Prior art examples of these type of golf club heads include U.S. Pat. Nos. D275,412 to Simmons, 2,550,840 to Milligan, 3,997,170 to Goldberg, 4,065,133 to Gordos, 4,900,029 to Sinclair, 5,203,565 to Murray et al, and 5,467,989 to Good et al. as well as my own U.S. Pat. Nos. 4,828,265, 4,930,783, 5,004,241, 5,193,810, 5,221,086 and 5,511,786 among others.

SUMMARY OF THE INVENTION

The present invention represents an improvement over known prior art wood type golf club heads by providing an aerodynamic surface on the bottom sole adjacent the rear edge of the club head, which produces greater club head speed when the club head is swung. This aerodynamic surface reduces undesirable air turbulence which causes aerodynamic drag and creates a smoother, laminar type air flow around the club head. A golf club using this improvement permits a golfer to hit longer and straighter golf shots for a given applied swing force. The aerodynamic structure also creates increased aerodynamic stability of the club head resulting in increased control of the club head position during the swing, especially at impact, thereby producing more consistent golf shots.

The golf club head of the present invention includes a c-shaped aerodynamic slot formed on the bottom sole surface of the club head. In a preferred embodiment, a metal wood type golf club head, having a smooth upper surface and sloped side walls, includes a c-shaped aerodynamic slot located adjacent the rear surface on the bottom surface or sole which generally follows the contours of the peripheral edges of the club head between the sole and the side walls. The open end of the c-shaped slot faces forwardly toward the front ball striking face of the club. The club head may also include a raised sole plate on the bottom surface having a spacer wall which also provides an aerodynamic effect and creates a skid structure enabling the club to skim across the ground surface when the club head is swung to hit a golf ball.

In another preferred embodiment, a venturi slot is provided between the c-shaped slot and the rear surface of the club head to further direct air flow adjacent the rear surface of the club head where most turbulence occurs.

The aerodynamic surfaces of the club head create aerodynamic effects which minimize turbulence and increase laminar air flow to reduce drag resulting in a more stable club head with higher speed for a given application of swing force by the golfer.

A primary object of the present invention is to provide a golf club head having an improved aerodynamic surface on the bottom sole adjacent the rear of the club head to substantially reduce drag and improve swing stability.

Another object is to provide a golf club head which increases club head speed and lift by concentrating air flow near the rear surface of the club head where turbulence occurs to reduce drag on the club head as it is swung.

Other objects and advantages of the present invention will become apparent in the following description of the preferred embodiments taken into conjunction with the accompanying drawings which are incorporated in and constitute a part of the specification and together with the description, serve to explain the principles of the present invention.

BRIEF DESCRIPTION OF THE DRAWINGS

FIG. 4 is an end elevational view thereof.

FIG. 5 is a sectional view taken along the lines 5—5 of FIG. 3.

FIG. 6 is a bottom view of a second embodiment of an aerodynamic golf club in accordance with the present invention.

FIG. 7 is a bottom perspective view of the golf club head of FIG. 6.

FIG. 8 is rear elevational view thereof.

FIG. 9 is a bottom view of a third embodiment of the present invention.

FIG. 10 is a bottom view of a forth embodiment of the present invention.

DESCRIPTION OF THE PREFERRED EMBODIMENTS

Figure 1:
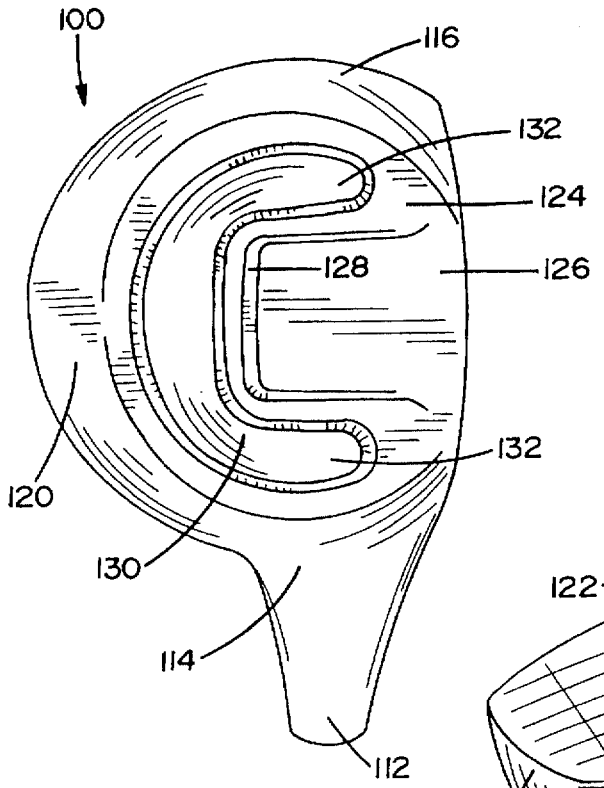
FIG. 1 is a bottom view of an aerodynamic golf club head in accordance with the present invention.
Figure 2:
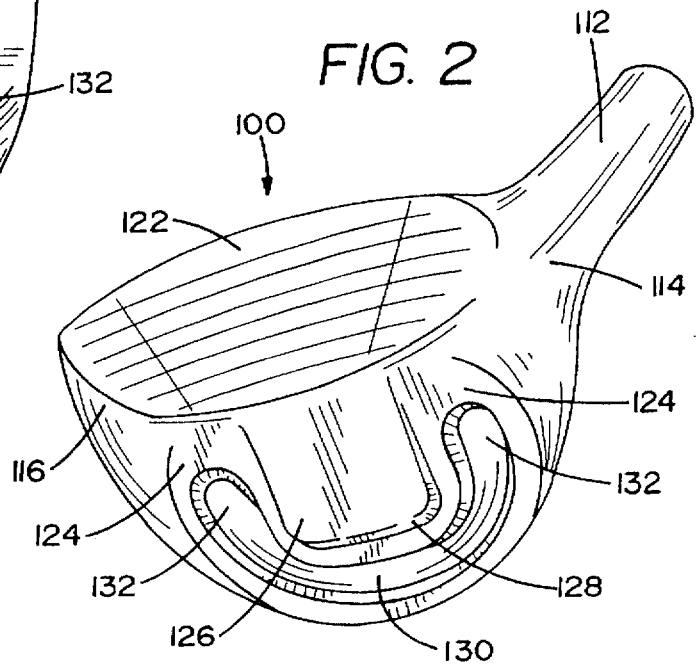
FIG. 2 is a bottom perspective view of the golf club head of FIG. 1.
Figure 3:
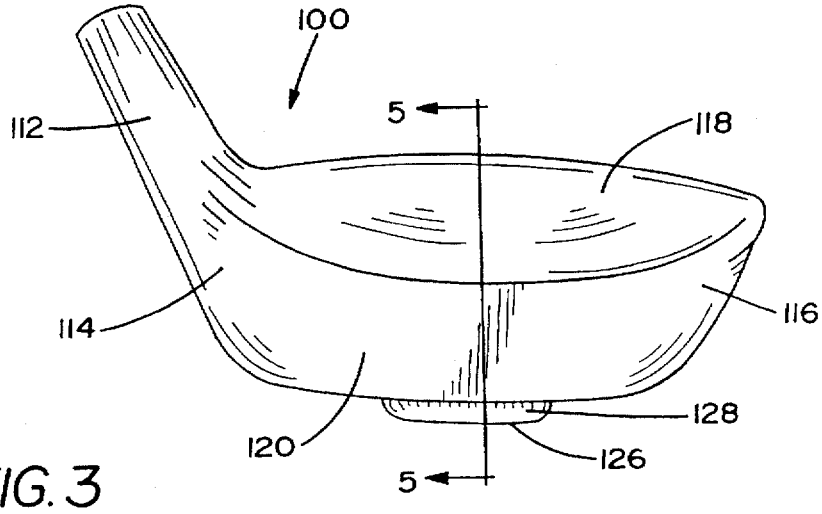
FIG. 3 is a rear elevational view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–5 show a first embodiment of a golf club head 100 in accordance with the present invention. The golf club head 100 is conventional in shape, except for the aerodynamic surfaces and includes a hosel 112, heel 114, toe 116, upper surface 118, rear surface 120, ball striking face 122 and bottom surface 124. The bottom sole 124 includes a skid member 126 which extends outwardly from the bottom sole 124 and is separated therefrom by a spacer wall 128. A c-shaped aerodynamic slot 130 is formed on the bottom surface 124 and faces forwardly with open ends 132 of the c-shaped slot 130 being toward the ball striking face 122. Preferably, the c-shaped slot 130 extends from a point adjacent the interface of the bottom surface 124 and rear surface 120 across approximately two thirds of the distance to the ball striking face 122.

The aerodynamic slot 130 catches air just behind the ball striking face 122 and directs it toward the rear surface 120 within the curved walls of the c-shaped slot 130 of the club head 100. The air is expelled rearwardly out of the slot to minimize turbulence and reduce drag as the club head 100 is swung. At the same time, the skid 126 and spacer walls 128 also serve to direct the air flow rearwardly to increase laminar flow in that area of the club head 100.

FIGS. 6, 7, and 8 show a second embodiment of a golf club head 200 in accordance with the present invention. This club head 200 is similar to that described to the club head hereinabove and includes a hosel 212, heel 214, toe 216, upper surface 218, rear surface 220, upper toe 230, side walls 222, a ball striking face 224, bottom surface 225, a skid 226 and a spacer wall 228 separating the skid 226 from the bottom surface 225. A c-shaped aerodynamic slot 230 is formed on the bottom surface 225 adjacent the rear surface 220. The open end of the slot 230 faces forwardly toward the ball striking face 224.

The slot 230 is formed with a venturi opening 232 which extends rearwardly and upwardly into the rear surface 220 creating an additional air channel to direct the air flow.

FIG. 9 shows another embodiment of the present invention. A golf club head 300 is similar to the club head described in FIGS. 1–5 and includes a bottom surface 325, a side surface 327 and an aerodynamic slot 330 which is offset in the direction of the toe 316 of the club head 300.

FIG. 10 shows another embodiment similar to FIG. 9. A golf club head 400 and includes a bottom surface 425, a side surface 427 and an aerodynamic slot 430 which is offset in the direction of the heel 414 of the club head 400.

It will be appreciated that the offset aerodynamic slots of FIGS. 9 and 10 allow greater club head speed at the heel or toe selectively in order to more effectively accommodate the swing characteristics of a particular golfer, whether left-handed or right-handed.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An aerodynamic golf club head including a club head body having a heel, toe, rear surface, ball striking face, upper surface and bottom surface, wherein the improvement comprises:

an aerodynamic configuration on said bottom surface adjacent said rear surface in the form of a c-shaped slot having an open end facing forwardly toward said ball striking face; said aerodynamic configuration further including a skid surface formed on and raised from said bottom surface; said skid surface having a wall separating said skid surface from said bottom surface.

2. The aerodynamic golf club head of claim 1 further including a venturi opening in fluid communication with and extending rearwardly from said c-shaped aerodynamic slot toward said rear surface.

3. The aerodynamic golf club head of claim 1 wherein said slot is further defined by being offset from said heel of said club head.

4. An aerodynamic golf club head including a club head body having a heel, toe, rear surface, ball striking face, upper surface and bottom surface, wherein the improvement comprises:

an aerodynamic configuration on said bottom surface adjacent said rear surface in the form of a c-shaped slot having an open end facing forwardly toward said ball striking face; said slot being offset from a center of said bottom surface centerline passing through a longitudinal in a heel-to-toe direction.

5. The aerodynamic golf club head of claim 4 wherein said slot is offset toward said heel.

6. The aerodynamic golf club head of claim 3 wherein said slot is offset toward said toe.

7. The aerodynamic golf club of claim 1 wherein said slot is further defined by being offset from said toe of said club head.

8. An aerodynamic golf club head including a club head body having a heel, toe, rear surface, ball striking face, upper surface and bottom surface, wherein the improvement comprises:

an aerodynamic configuration on said bottom surface adjacent said rear surface in the form of a c-shaped slot having an open end facing forwardly toward said ball striking face; said aerodynamic configuration further including a venturi opening in fluid communication with and extending rearwardly from said c-shaped aerodynamic slot toward said rear surface.

* * * * *

UNITED STATES PATENT AND TRADEMARK OFFICE

CERTIFICATE OF CORRECTION

PATENT NO. : 5,735,754
APPLICATION NO. : 08/759924
DATED : April 7, 1998
INVENTOR(S) : Anthony J. Antonious It is certified that error appears in the above-identified patent and that said Letters Patent is hereby corrected as shown below:

In Col. 4, Line 28, Claim 6: Change “3” to --4--

Signed and Sealed this

First Day of July, 2008

JON W. DUDAS
*Director of the United States Patent and Trademark Office*

US005735754C1

(12) EX PARTE REEXAMINATION CERTIFICATE (7290th)

United States Patent

Antonious

(10) Number: US 5,735,754 C1

(45) Certificate Issued: Jan. 5, 2010

(54) AERODYNAMIC METAL WOOD GOLF CLUB HEAD

(75) Inventor: Anthony J. Antonious, Sarasota, FL (US)

(73) Assignee: Anthony J Antonious Irrevocable Trust, Wanaque, NJ (US)

Reexamination Request:
No. 90/010,266, Sep. 2, 2008

Reexamination Certificate for:

| | |
|---|---|
| Patent No.: | **5,735,754** |
| Issued: | **Apr. 7, 1998** |
| Appl. No.: | **08/759,924** |
| Filed: | **Dec. 4, 1996** |

Certificate of Correction issued Jul. 1, 2008.

(51) Int. Cl.
*A63B 53/04* (2006.01)

(52) U.S. Cl. ..... 473/328; 473/345

(58) Field of Classification Search ..... None
See application file for complete search history.

(56) References Cited

U.S. PATENT DOCUMENTS

| | | | | |
|---|---|---|---|---|
| D350,176 | S | * 8/1994 | Antonious | D21/752 |
| 5,456,469 | A | * 10/1995 | MacDougall | 473/328 |
| D363,961 | S | 11/1995 | Krzynowek et al. | |
| D372,063 | S | 7/1996 | Hueber | |
| 6,257,991 | B1 | 7/2001 | Ortiz | |

OTHER PUBLICATIONS

Golf Magazine, Mar. 1994, p. 66, Ben Hogan H40 irons, H40 Woods.

Golf Digest, Mar. 1994, p. 11, Advertisement for Ben Hogan H40s.

Golf Digest, Apr. 1994, p. 93, Advertisement for Ben Hogan H40 cast clubs.

Golf Magazine, May 1994, Advertisement for Ben Hogan H40 cast clubs.

Golf Digest, May 1994, p. 175, Advertisement for Ben Hogan H40 cost clubs.

Golf Magazine, Jun. 1994, p. 145, Advertisement for Ben Hogan H40 cast clubs.

Golf Digest, Jun. 1994, p. 185, Advertisement for Ben Hogan H40 cast clubs.

Nicklaus Golf Equipment, Promotional Materials Issued Prior to the 1996 PGA Merchandise Show held in Orlando, FL on Jan. 26–29, 1996.

Petersen's Golfing, 1996, Test Drive: The Nicklaus air Bear Driver.

Golf Digest, Apr. 1996, 196 Show Products, A titanium sampler . . . Nicklaus Golf's Air Bear.

Golf Magazine, Mar. 1996, Advertisement for Nicklaus Air Bear.

Golf Magazine, Apr. 1996, Advertisement for Nicklaus Air Bear.

Golf Magazine, May 1996, Advertisement for Nicklaus golf products.

Golf Magazine, Sep. 1996, p. 70, Sizing It Up by Rob Sauerhaft.

* cited by examiner

*Primary Examiner*—Peter C. English

(57) ABSTRACT

A metal wood type golf club head having a c-shaped aerodynamic configuration formed in the bottom surface adjacent a rear surface and having an open end extending forwardly toward the ball striking face in combination with a skid surface.

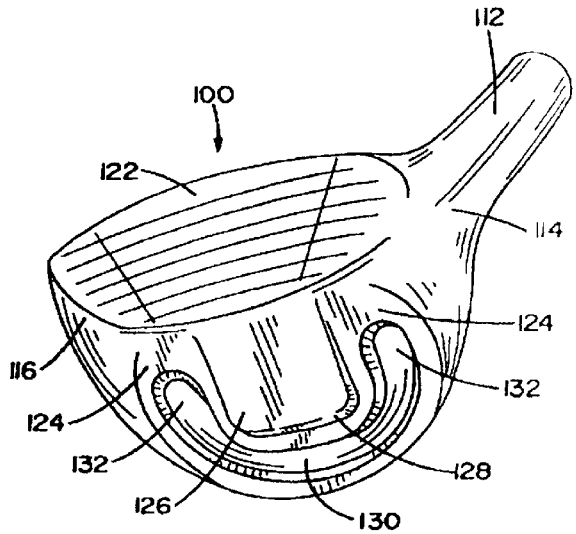

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines. 53–67:

FIGS. 1–5 show a first embodiment of a golf club head 100 in accordance with the present invention. The golf club head 100 is conventional in shape, except for the aerodynamic surfaces and includes a hosel 112, heel 114, toe 116, upper surface 118, rear surface 120, ball striking face 122 and bottom surface 124. The bottom sole 124 includes a skid member 126 which extends outwardly from the bottom sole 124 and is separated therefrom by a spacer wall 128. A c-shaped aerodynamic slot 130 is formed on*, and substantially parallel with,* the bottom surface 124 and faces forwardly with open ends 132 of the c-shaped slot 130 being toward the ball striking face 122. *As shown in FIG. 1, c-shaped aerodynamic slot 130 transects a virtual centerline that passes through ball striking face 122 and rear surface 120 of the club head.* Preferably, the c-shaped slot 130 extends from a point adjacent the interface of the bottom surface 124 and rear surface 120 across approximately two thirds of the distance to the ball striking face 122.

Column 3, lines 22–26:

FIG. 9 shows another embodiment of the present invention. A golf club head 300 is similar to the club head described in FIGS. 1–5 and includes a bottom surface 325, a side surface 327 and an aerodynamic slot 330 *on said bottom surface* which is *substantially parallel with the bottom surface, and* offset *from a virtual centerline that passes transversely through a heel-to-toe axis of the club head,* in the direction of the toe 316 of the club head 300, *with a portion of slot 330 passing through the virtual centerline.*

Column 3, lines 27–30:

FIG. 10 shows another embodiment similar to FIG. 9. A golf club head 400 [and] includes a bottom surface 425, a side surface 427 and an aerodynamic slot 430 *on said bottom surface* which is offset *from a virtual centerline that passes transversely through a heel-to-toe axis of the club head,* in the direction of the heel 414 of the club head 400, *with a portion of slot 430 passing through the virtual centerline.*

AS A RESULT OF REEXAMINATION, IT HAS BEEN DETERMINED THAT:

The patentability of claim 8 is confirmed.

Claim 4 is cancelled.

Claims 1, 3, 5, 6 and 7 are determined to be patentable as amended.

Claim 2 dependent on an amended claim, is determined to be patentable.

New claim 9 is added and determined to be patentable.

1. An aerodynamic golf club head including a club head body having a heel, toe, rear surface, ball striking face, upper surface and bottom surface, wherein the improvement comprises:

an aerodynamic configuration on*, and substantially parallel with,* said bottom surface adjacent said rear surface in the form of a c-shaped slot having an open end facing forwardly toward said ball striking face; said aerodynamic configuration further including a skid surface formed on and raised from said bottom surface; said skid surface having a wall separating said skid surface from said bottom surface*, said c-shaped slot transecting a virtual centerline passing through said ball striking face and said rear surface of said club head.*

3. The aerodynamic golf club head of claim 1 wherein said slot is [further defined by being] offset from said heel of said club head.

5. The aerodynamic golf club head of claim [4] *9* wherein said slot is offset toward said heel.

6. The aerodynamic golf club head of claim [4] *9* wherein said slot is offset toward said toe.

7. The aerodynamic golf club of claim 1 wherein said slot is [further defined by being] offset from said toe of said club head.

*9. An aerodynamic golf club head including a club head body having a heel, toe, rear surface, ball striking face, upper surface and bottom surface, in which the improvement comprises:*

*an aerodynamic configuration within, and substantially parallel to, said bottom surface, adjacent said rear surface, in the form of a c-shaped slot having an open end facing forwardly toward said ball striking face, said slot offset from, and a portion thereof passing through, a virtual centerline passing transversely through a heel-to-toe axis of said club head.*

* * * * *